United States Patent [19]

Schedele

[11] Patent Number: 4,672,344

[45] Date of Patent: Jun. 9, 1987

[54] POLARIZED ELECTROMAGNETIC RELAY

[75] Inventor: Helmut Schedele, Diessen, Fed. Rep. of Germany

[73] Assignee: Siemens Aktiengesellschaft, Berlin and Munich, Fed. Rep. of Germany

[21] Appl. No.: 851,717

[22] Filed: Apr. 14, 1986

[30] Foreign Application Priority Data

Apr. 19, 1985 [DE] Fed. Rep. of Germany ..... 3514256

[51] Int. Cl.[4] ..... H01F 7/08

[52] U.S. Cl. ..... 335/230; 335/81

[58] Field of Search ..... 335/78, 80, 81, 229, 335/230, 235

[56] References Cited

U.S. PATENT DOCUMENTS 4,091,346 5/1978 Nishimura et al. ..... 335/78
4,215,329 7/1980 Kobler ..... 335/78
4,311,976 1/1982 Sauer et al. ..... 335/78
4,560,966 12/1985 Nagamoto et al. ..... 335/81 X
4,577,172 3/1986 Schedele et al. ..... 335/80
4,577,173 3/1986 Schedele et al. ..... 335/80

*Primary Examiner*—George Harris
*Attorney, Agent, or Firm*—Hill, Van Santen, Steadman & Simpson

[57] ABSTRACT

A polarized electromagnetic relay has an armature extending through an axial opening in a coil body, a free end of the armature being switchable between two planar pole plates. The pole plates each have pole members disposed opposite one another and each further have top and bottom stop tabs received in spacer members which are a part of a flange of the coil body. Each pole plate with the pole members and stop tabs is stamped in a single cutting from sheet material. By positioning the stop tabs within the spacer members, a precise contact spacing between the two pole plates is insured with a low tolerance during assembly.

9 Claims, 7 Drawing Figures

POLARIZED ELECTROMAGNETIC RELAY

BACKGROUND OF THE INVENTION

1. Field of the Invention

The present invention relates to a polarized electromagnetic relay, and in particular to such a relay having an armature extending axially through an opening in a coil body and having a free end moveable between two pole plates disposed at one flange of the coil body.

2. Description of the Prior Art

A polarized electromagnetic relay having a tongue-shaped armature extending axially through an opening in a coil body having opposite spaced flanges is described in U.S. Pat. No. 4,215,329. The relay has a free end disposed at one of the flanges switchable between two pole plates. At least one portion of the pole plates lies flat against the end face of the coil flange and also lies against two spacer members attached to the coil body, which define the spacing between the two pole plates by the thickness of the spacer members. A four-pole permanent magnet arrangement has two poles of opposite plurality disposed against each of the two pole plates.

Using the structure disclosed in aforementioned U.S. Pat. No. 4,215,329, it is possible to construct an extremely small relay having a highly sensitive magnetic circuit. In this known relay, the two pole plates are each angled in three orthogonal planes, with one portion disposed against the coil body at the end face forming pole faces for the permanent magnet, a further portion plugged into the coil body parallel to the coil axis forming the contact surfaces and the working air gap with the armature, and a third portion extending laterally next to the coil body forming a coupling surface with the ferromagnetic housing cap with an interposed foil fixing a defined air gap. This design insures relatively large area contact and pole surfaces for the working air gap, however, the portions plugged into the flange parallel to the coil axis require a corresponding space within the overall structure. For further miniaturization of such a relay, the pole plates should be situated such that the axial length of the relay is enlarged as little as possible.

A similar structure is described in U.S. Pat. No. 4,091,346 wherein two angled pole plates each have one portion disposed flat against the end face of the coil body flange, and each have a further portion extending away from the coil body parallel to the coil axis. The further portions enclose a twopole permanent magnet in the volume therebetween. This permanent magnet is polarized perpendicularly to the coil axis. In this structure, the pole plates and the permanent magnet require an unnecessarily large volume because the defined minimum pole surfaces are required for coupling the permanent magnet. These pole surfaces extend in the longitudinal direction of the relay in front of the coil body flange. Although the contact and pole surfaces of the working air gap are attached at the end face of the pole plate portions which are perpendicular to the coil axis, and thus require little space in the axial direction, the free end of the armature contact tongue which is moveable therebetween requires sufficient space for freedom of movement, so that the permanent magnet must be disposed at a certain distance from the armature contact tongue, thus requiring additional space in the axial direction. The relative positions of the contact and pole surfaces forming the working air gap can be precisely adjusted by adding spacer blocks to the coil body adjacent the contact surfaces. Problems are still present, however, because of the accessibly small air and creep paths between the lengthened portions of the contact surfaces which are disposed opposite each other.

U.S. Pat. No. 4,577,173 describes a relay designed to achieve a relay length which is as small as possible, wherein the pole plates are planar and are placed flat against the end face of the coil body, and a permanent magnet is disposed against the pole plates at the end face with a foil interposed therebetween. The contact surfaces in this relay are disposed at the end faces of respective pole members which are slightly bent or crimped toward the interior of the coil. The contact spacing is defined by additional stop tabs which are cut within the respective pole members and pressed against spacer members of the coil body flange. In order to obtain adequate air and creep paths between these stop tabs, the stop tabs are shortened in comparison to the pole members, thus requiring the spacer members of the coil body flange to have a greater width than the contact distance between the two pole surfaces. In providing for assembly of this relay, however, it has become apparent that maintaining the tolerances between the stop faces of the stop tabs disposed in various planes and the pole surfaces at a small value is very difficult, given a pole surface spacing of a few tenths of a millimeter. Accurately maintaining such tolerances is necessary for a faultless functioning of the relay. These tolerances also have an unfavorable effect for contact spacings within this order of magnitude because the differing material contraction of the plastic used in manufacturing the coil body already contributes a noticeable influence on the spacing members.

SUMMARY OF THE INVENTION

It is an object of the present invention to provide a relay having planar pole pieces with an armature moveable therebetween wherein the edges of the pole pieces form the pole surfaces and in which the gap between the pole surfaces can be easily maintained during manufacture within small tolerances.

A further object of the present invention is to provide such a relay which is suitable for miniaturization.

Another object of the present invention is to provide such a relay wherein the air and creep paths between the pole plates can be of acceptable length while maintaining good sensitivity of the magnetic circuit.

The above objects are inventively achieved in a relay wherein the pole plates are positioned between spacer members, and a retaining nose is provided at opposite edges of the coil body flange against which the pole plates are adjacent, so that the pole plates are held between the spacer members and the retaining noses by press fit. The edge faces of the pole plates forming the pole surfaces for the armature are formed on a central tab or projection of each pole plate which is disposed between stop surfaces which abut the spacers. The stop surfaces and the pole surfaces for each pole plate are co-planar, so that abutting the stop surfaces against the spacers simultaneously sets and maintains the gap between the pole surfaces at a selected distance.

Due to the selected shaping of the pole plates and the means for fastening the pole plates to the coil body, a minimum axial length for the relay results, thereby contributing to ease of miniaturization of the relay. The pole plates extend the axial length of the relay only in the amount of the thickness of the pole plates. Low-tolerance manufacture and functional reliability of the relay is further enhanced in that the pole surfaces and seating surfaces are disposed in one plane and can thus be formed with one stamping punch in a single punching operation. There is thus no specific tolerance which must be maintained between the stop surfaces and the pole surface on each pole plate. Additionally, the required creep and air paths are assured by the regions cut free between the projection carrying the pole surface and the stop tabs, with respective stop tabs for the two pole plates being disposed opposite each other with the intervening spacing members providing insulation therebetween. The thickness of the spacer members precisely defines the contact or gap distance, and since these spacer members are only a few tenths of a millimeter in thickness, the percentage of material contraction therein will have minimum, if any, effect.

In order to further improve the insulating paths between the stop tabs of the pole plates disposed opposite each other, a further embodiment of the relay provides spacer members which are respectively disposed between two base carriers and form a T-shaped element. As stated above, the pole plates, including the pole surface tab and the stop tabs, can be completely planar. It is also possible in a further embodiment of the invention to fashion the pole plates including the stop tabs planar and to slightly crimp the pole surface tabs, or to obliquely bend the pole surface tabs in a direction toward the armature. In this embodiment as well, however, it must be assured that the pole surfaces are disposed in a common plane with the seating surfaces for the stop tabs.

In another embodiment, the stop tabs may also be bent slightly toward the interior of the relay, which further improves the insulating paths between the two pole plates.

The permanent magnet system preferably has two separate permanent magnets respectively polarized parallel to the coil axis and opposite each other, which are spaced from each other in the region of the free armature end. This insures not only free mobility of the armature, but also avoids an unacceptably short creep path over the permanent magnet in front of the working air gap.

In another embodiment of the relay, the contact space in front of the free armature end may be closed by a sealing foil, and the relay can then be cast in a standard manner. The sealing foil is preferably placed over the end face exteriors of the two permanent magnets, and does not affect the aforementioned spacing between the permanent magnets. Another foil may be disposed between the pole plates and the two permanent magnets such that the foil has a bulge toward the exterior of the relay extending into the space between the two permanent magnets, with the bulge being disposed in the region in front of the free armature end. The bulge can be formed by deep-drawing the foil, and can be formed around the free armature end and, under certain conditions, around the spacer members of the coil body so that the insulating paths and the free armature mobility are maintained. Given the space available in this embodiment, the spring forming the armature may have a maximum length extending into the plane of the pole surfaces of the permanent magnets, so that the spring characteristics thereof can be optimized. The use of such a deep-drawn foil also avoids communication of the permanent magnets with the contact space.

The permanent magnets may be fixed to the coil body flange with deformed tabs.

DESCRIPTION OF THE PREFERRED EMBODIMENTS

Figure 1:
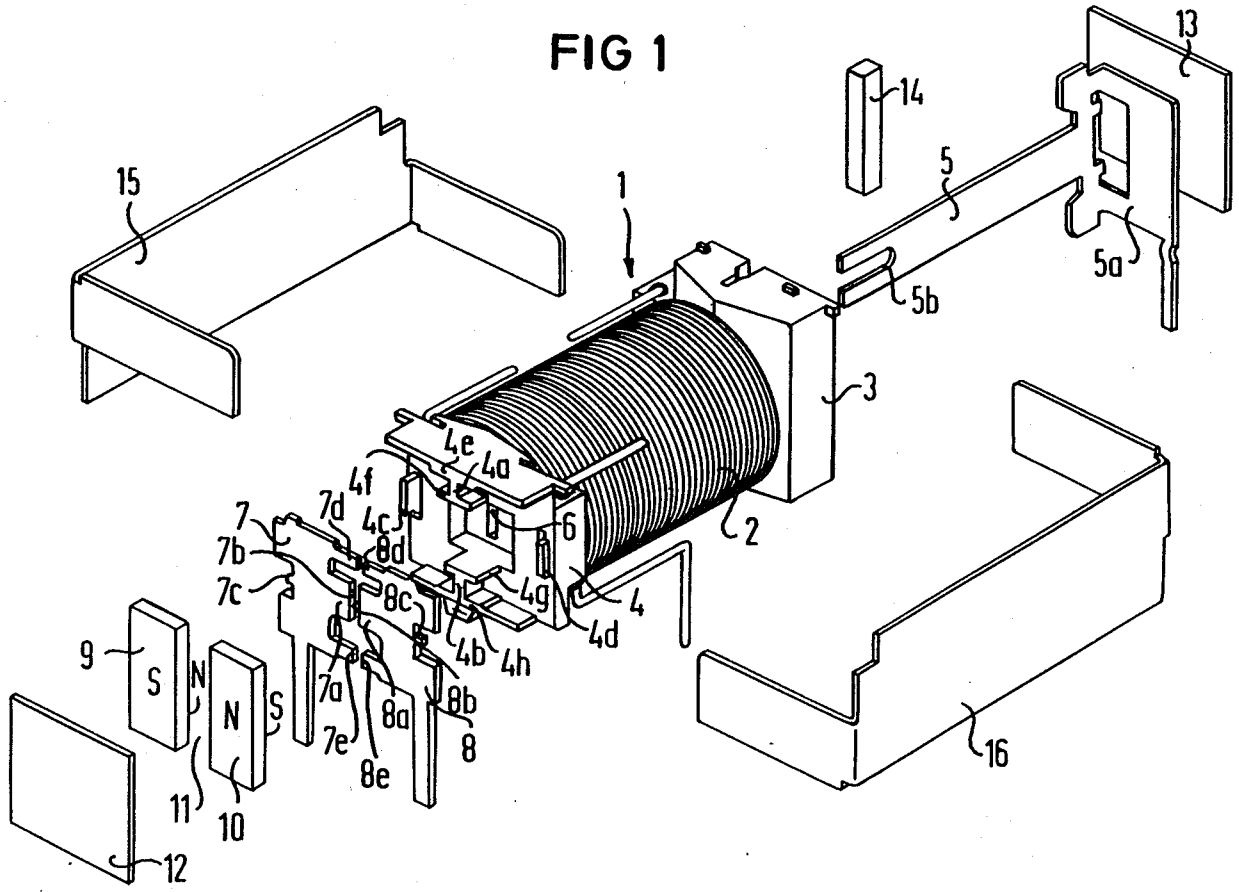
FIG. 1 is an exploded perspective view of an electromagnetic relay constructed in accordance with the principle of the present invention.

An exploded view of a relay constructed in accordance with the principles of the present invention as shown in FIG. 1. The relay has a coil body 1 having a winding 2 disposed between spaced end flanges 3 and 4. A tongue or spring armature 5 is inserted through an axial opening 6 of the coil body 1, and one end thereof is fixed with a fastening tab 5*a* to the flange 3. The armature 5 has a free end 5*b* moveable between two pole plates 7 and 8 in the region of the other coil flange 4.

The two pole plates 7 and 8 are each punched or stamped from planar sheet metal material. The pole plates 7 and 8 have respective central tabs 7*a* and 8*a* cut free. The inwardly disposed narrow face or edge of each tab 7*a* and 8*a* forms a pole surface 7*b* and 8*b* facing opposite sides of the free end 5*b* of the armature 5. Stop tabs 7*e* and 7*d* are disposed respectively above and below the central tab 7*a*, and corresponding stop tabs 8*e* and 8*d* are respectively disposed above and below the central tab 8*a*. The stop tabs 7*d* and 8*d* abut a spacer member 4*a* disposed therebetween and carried on the flange 4, and the stop tabs 7*e* and 8*e* abut a similar spacer member 4*b* disposed therebetween. The outer edges of the pole plates 7 and 8 are disposed against respective retaining noses 4*c* and 4*d*, also carried on the flange 4, so that the pole plates 7 and 8 are repectively press fix between the spacer members 4*a* and 4*b* and the retaining noses 4*c* and 4*d*. The pole plates 7 and 8 may be provided with respective outer projections or tabs 7*c* and 8*c* abutting the retaining noses 4*c* and 4*d*. The outer projections 7*c* and 8*c* may be disposed within respective recesses cut in the outer edges of the plates 7 and 8.

In addition to the portion of each spacer member 4*a* and 4*b* disposed between the pole plates 7 and 8, the spacer members also include respective portions 4*e* and 4*h* between which the pole plates 7 and 8 are held, and surfaces 4*f* and 4*g* forming oppositely disposed T-shaped elements in combination with the portion of the spacer members disposed between the pole plates 7 and 8.

Figure 4:
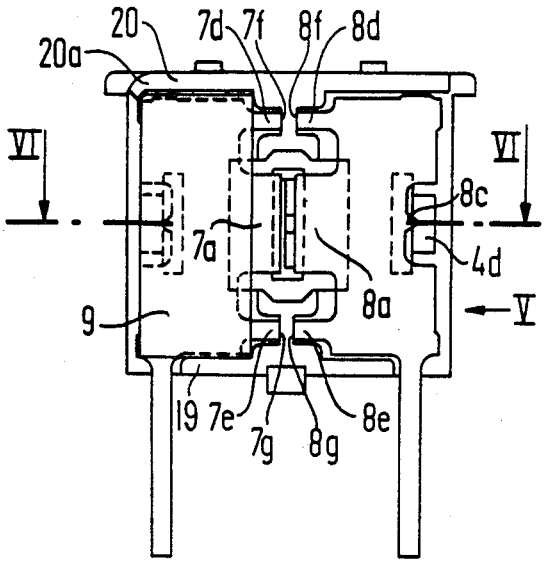
FIG. 4 is an end view of the assembled relay constructed in accordance with the principles of the present invention with the cover and yoke plates removed.

As best shown in FIG. 4, each stop tab of the pole plates 7 and 8 is provided with a stop surface which abuts one of the spacer members 4*a* or 4*b*. The stop surfaces are respectively designated 7*f*, 7*g*, 8*f* and 8*g*. The stop surfaces 7*f* and 7*g* are co-planar with the pole surface 7*b*, and the stop surfaces 8*f* and 8*g* are co-planar with the pole surface 8*b*. Thus, the portions of the spacer members 4*a* and 4*b* disposed between the respective stop surfaces also define the gap or distance between the pole surfaces 7*b* and 8*b*. During assembly, therefore, this gap is automatically set at the time the pole plates 7 and 8 are pressed into position on the flange 4.

The T-shape of the spacer members not only improves stability and retention of the pole plates 7 and 8, but also provides the necessary insulation between the two plates.

Figure 2:
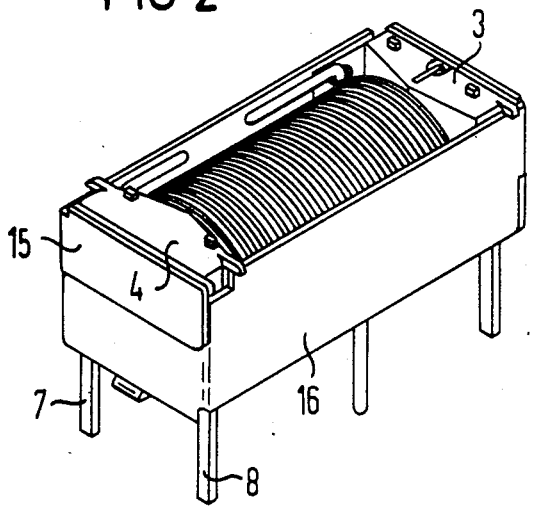
FIG. 2 is an assembled view, with the cover removed, of an electromagnetic relay constructued in accordance with the principles of the present invention.

Permanent magnets 9 and 10 are respectively disposed adjacent the pole plates 7 and 8, or at least against portions thereof. The magnets 9 and 10 are oppositely polarized, with the direction of polarization being in the axial direction. A space 11 is maintained open between the two magnets 9 and 10 as showing freedom of movement of the free armature end 5*b* and simultaneously lengthening the creep path between the two pole plates 7 and 8. A sealing foil 12 is disposed on the outside of the two permanent magnets 9 and 10 in showing a preliminary seal of the relay and preventing the flow of casting compound into the contact space during subsequent casting. Another foil 13 is also placed on the armature fastening tab 5*a* at the opposite end of the relay after getter material 14 has been introduced at the region of the coil flange 3. Yoke plates 15 and 16 having a U-shape are placed over the assembly from opposite sides, with the assembly shown in FIG. 2, without the cover, resulting. The assembly of FIG. 2 can then be provided with a cap or other type of cover (not shown) and sealed, or may be directly embedded in casting compound without a cap.

Figure 3:
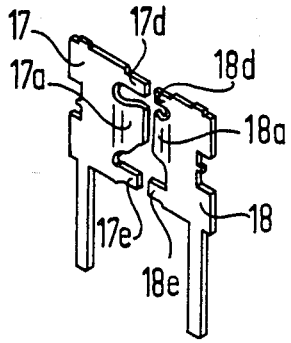
FIG. 3 is a perspective view of a modified version of the two pole plates for use in the relay constructed in accordance with the principles of the present invention.
Figure 5:
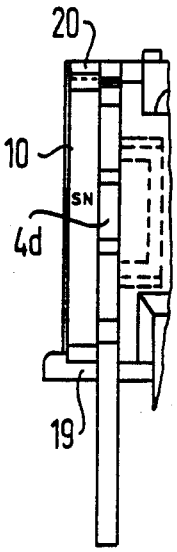
FIG. 5 is a side view of a portion of the relay shown in FIG. 4.

Modified pole plates 17 and 18 are shown in FIG. 3, having slightly crimped or obliquely bent central tabs 17*a* and 18*a*. The central tabs 17*a* and 18*a* are bent toward the interior of the relay, otherwise the pole plates are fashioned exactly as the pole plates 7 and 8 described above. The stop tabs 17*d*, 17*e*, 18*d* and 18*e* must be fashioned so that their edge surfaces are coplanar with the pole surface of the associated central tab.

Figure 6:
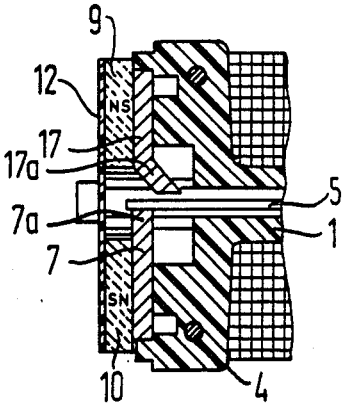
FIG. 6 is a sectional view taken along lines VI—VI of FIG. 4.

The two types of pole plates are shown in sectional view in FIG. 6 with a planar pole plate from FIG. 1 being shown at the lower portion of FIG. 6, and a bent plate 17 as shown in FIG. 3 is at the top of FIG. 6. With both types of pole plates, the respective pole surfaces must be disposed parallel to the coil axis, so that the pole surfaces are also manufactured in one stamp at the same time as the associated stop faces of the stop tabs on the same pole plate are formed. As can be seen in FIG. 6, the armature 5 can be longer in the embodiment using planar pole plates 7 and 8, thereby giving the armature 5 a lower spring rate. The use of pole plates 17 and 18 having central tabs bent toward the interior of the relay results in an improved magnetic circuit requiring lower magnetic excitation.

In a further embodiment not illustrated, the stop tabs 17*d*, 17*e*, 18*d* and 18*e* may be bent toward the interior of the coil in addition to the central tabs 17*a* and 18*a*. In this embodiment, a single magnet having quadripole magnetization could be used instead of the two magnets 9 and 10. In this embodiment, the foil 12 disposed between the pole plates and the permanent functions as insulation.

As shown in FIG. 4 the two permanent magnets (only the magnet 9 is shown) are disposed against the pole plates and are held at their respective top and bottom by projecting walls 19 and 20. The wall 20 at the upper side can be deformed at the corners so that a tab 20*a* retains the permanent magnet 9. A similar tab can be provided at the opposite side for the permanent magnet 10.

Figure 7:
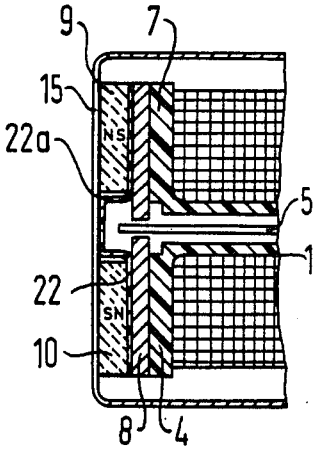
FIG. 7 is a section taken along the same section as FIG. 6 of a further embodiment of the relay.

Another embodiment is shown in section in FIG. 7 wherein, instead of the flat foil 12, a deep-drawn foil 22 is provided which is disposed at both sides between the pole plates 7 and 8 and the magnets 9 and 10. The foil 22 has a bulge 22*a* toward the exterior of the relay in the central region between the two permanent magnets 9 and 10. This avoids communication of the permanent magnets 9 and 10 with the contact space. The armature 5 is provided with sufficient freedom of movement at its free end 5*b* and the required insulating paths between the pole plates 7 and 8 and the armature 5 are guaranteed. The remainder of the relay of FIG. 7 is constructed as the relay of FIG. 1.

Although modifications and changes may be suggested by those skilled in the art it is the intention of the inventor to embody within the patent warranted hereon all changes and modifications as reasonably and properly come within the scope of his contribution to the art.

I claim as my invention:

1. A polarized electromagnetic relay comprising:

a coil body having a hollow axially extending opening therein and spaced flanges at opposite ends of said body with an excitation coil wound therebetween;

two spaced substantially planar pole plates held in one of said coil body flanges;

an armature extending through said opening in said coil body having a free end moveable between said pole plates at said one coil body flange and a fixed end disposed at the other coil body flange;

two oppositely disposed spacer members and two oppositely disposed retaining noses formed on said one coil body flange for retaining said pole plates by press fit;

a central projection on each pole plate having an edge forming a pole surface disposed adjacent said free end of said armature, and two spaced stop projections on each pole plate respectively abutting said spacer members at a surface of each stop projection co-planar with said pole surface such that a gap between the pole surfaces of the two pole plates is fixed by said spacer members; and a four pole permanent magnet system having two opposite poles respectively disposed adjacent at least a portion of said pole plates.

2. An electromagnetic relay as claimed in claim 1, wherein said spacer members each have two oppositely disposed carrier members between which said stop projections of said pole plates are received, each carrier member forming a T-shape with said spacer member.

3. An electromagnetic relay as claimed in claim 1, wherein said central projection on each said pole plate is co-planar with said pole plate.

4. An electromagnetic relay as claimed in claim 1, wherein said central projection on each pole plate is bent in a direction toward said armature.

5. An electromagnetic relay as claimed in claim 1, wherein said excitation coil has a longitudinally extending coil axis and wherein said permanent magnet system consists of two permanent magnets disposed with a free space therebetween at said free end of said armature, said permanent magnets being oppositely polarized in a direction parallel to said coil axis.

6. An electromagnetic relay as claimed in claim 5, further comprising a sealing foil disposed at an exterior side of said permanent magnets away from said pole plates.

7. An electromagnetic relay as claimed in claim 5, further comprising an insulating foil disposed between said pole plates and said permanent magnets, said insulating foil having a bulge extending in said free space between said permanent magnets in front of said free end of said armature.

8. An electromagnetic relay as claimed in claim 5, further comprising two spaced magnet carriers on said one coil body flange, at least one of said magnet carriers having a deformed tab, said magnet carriers being disposed on opposite sides of said permanent magnets for holding said permanent magnets respectively therebetween.

9. A polarized electromagnetic relay comprising:

a coil body having a hollow axially extending opening therein and spaced flanges at opposite ends of said body with an excitation coil wound therebetween;

an armature extending through said opening in said coil body having a moveable free end disposed at one of said flanges, and a fixed and disposed at the other of said flanges;

retaining means disposed on said one coil body flange including two oppositely disposed spacer members;

two spaced substantially planar pole plates held by said retainer means at said one coil body flange on opposite sides of said free end of said armature with one edge of each pole plate facing said armature, each pole plate having a plurality of spaced notches in said edge defining a plurality of projections of said edge, each projection terminating co-planar with said edge, two of said projections abutting said spacer members and at least one other of said projections forming a pole surface adjacent said armature, said projections abutting said spacer members defining a gap between the respective pole surfaces of said two pole plates; and a four pole permanent magnet system having two opposite poles respectively disposed adjacent at least a portion of said pole plate.

* * * * *